US011845298B2

(12) United States Patent
Mutoh

(10) Patent No.: US 11,845,298 B2
(45) Date of Patent: Dec. 19, 2023

(54) WRITING INSTRUMENT HAVING COLOR INDICATION-CHANGEABLE GRIP

(71) Applicant: MICRO CO., LTD., Tokyo (JP)

(72) Inventor: Ayaka Mutoh, Fukushima-ken (JP)

(73) Assignee: MICRO CO., LTD.

( * ) Notice: Subject to any disclaimer, the term of this patent is extended or adjusted under 35 U.S.C. 154(b) by 0 days.

(21) Appl. No.: 17/965,417

(22) Filed: Oct. 13, 2022

(65) Prior Publication Data

US 2023/0294447 A1 Sep. 21, 2023

(30) Foreign Application Priority Data

Mar. 17, 2022 (JP) ..... 2022-42123
Apr. 1, 2022 (JP) ..... 2022-61777

(51) Int. Cl.
*B43K 23/008* (2006.01)
*B43K 7/00* (2006.01)
*B43K 29/007* (2006.01)

(52) U.S. Cl.
CPC ..... *B43K 23/008* (2013.01); *B43K 7/005* (2013.01); *B43K 29/007* (2013.01)

(58) Field of Classification Search
CPC .... B43K 23/008; B43K 7/005; B43K 23/004; B43K 23/012; B43K 23/016; B43K 23/02; B43K 29/00; B43K 29/007; B43K 29/087; B43K 29/0875
USPC ..... 401/6, 195
See application file for complete search history.

(56) References Cited

U.S. PATENT DOCUMENTS 1,787,889 A * 1/1931 White ..... G06M 11/00 235/64
2,646,220 A * 7/1953 Weiser ..... B43K 29/093 235/87 R
4,207,695 A * 6/1980 Penza, Jr. ..... B43K 7/12 40/334
4,984,494 A * 1/1991 Yang ..... B43K 29/005 84/474

FOREIGN PATENT DOCUMENTS

| | | |
|---|---|---|
| JP | 3008909 | 1/1995 |
| JP | 3100918 | 1/2004 |
| JP | 2008230180 | 10/2008 |

* cited by examiner

*Primary Examiner* — David J Walczak
(74) *Attorney, Agent, or Firm* — ADAMS & WILKS

(57) ABSTRACT

A writing instrument has a gripping tube rotatably fitted on a front portion of a barrel. At the front portion of the barrel, plural identifying marks having different identification characteristics, such as color, are disposed in parallel in a circumferential direction of the barrel. A window portion is provided in the gripping tube through which is visible an identifying mark selected by rotating the gripping tube relative to the barrel. When the user rotates the gripping tube to the position where the chosen color is visible through the window portion, a locking pawl on the barrel engages with a locking groove at the rear end of the gripping tube to lock the gripping tube in this position. Once locked in position, the gripping tube cannot accidentally rotate thereby preventing a change of colors appearing at the window portion even if the writing instrument is subjected to shock or vibration.

10 Claims, 19 Drawing Sheets

1
5
B
A
15
15
3
12

1
5
B
A
15
3
12

1
23
14
14
1
5
5
13
13
1
3
12

5
13
1

WRITING INSTRUMENT HAVING COLOR INDICATION-CHANGEABLE GRIP

FIELD OF THE INVENTION

The present invention relates to a writing instrument having a color indication-changeable grip in which color indication can be changed by rotating a gripping tube disposed on a holding section of writing instruments such as mechanical pencils or ball point pens.

BACKGROUND INFORMATION

Among writing instruments provided with a grip, for example, ball point pens are often designed to enable adjustment of the color of a part or whole body of a barrel main body, a grip, a knocking member, etc. in conformity with an ink color of a refill housed in a barrel, for creating a writing instrument with a distinctive appearance. For example, some users may want a barrel main body in black and a red grip, others may prefer a blue main barrel body and a black grip. A popular trend today is for users to customize the combination of colors of their writing instruments to suit their personal taste or show their originality. However, in order to customize the colors, it is necessary to buy two ball point pens of the same model and in different colors, disassemble them and combine their parts into desired colors, and reassemble them into one desired ball point pen. In such instances, the remaining parts becomes useless, resulting in monetary loss.

JP Registered Utility Model Nos. 3008909 and 3100918 describe writing instruments manufactured by forming plural annular members having different patterns, figures, etc. so that the color arrangement can be changed to the user's preference by changing the combination of the annular members, and attaching them to a barrel. However, such a structure in which the color arrangement, etc. can be changed by preparing plural annular members and suitably combining them, results in a large number of parts and the structure becomes complicated, and it is therefore difficult to manufacture and sell such writing instruments at a competitive price. In addition, it is cumbersome to change the combination, it is not possible to easily change the structure, and the newly combined state may unwantedly change.

JP 2008-230180 A describes a writing instrument in which a grip disposed on a gripping section of a barrel has a double layer structure made of an inner grip and an outer grip, wherein the surface color of the gripping section can be visually recognized through a through-hole formed on a side surface of the inner grip by rotating the inner grip. However, in this writing instrument, before rotating the inner grip, it is required to detach the outer grip, such being cumbersome in operation. Further, visual recognition is difficult when the position of the surface color does not accurately match with the position of the through-hole of the inner grip, and therefore the position of the surface color and the position of the through-hole may be unwantedly changed by rotation of the inner grip due to vibration or shock during use.

SUMMARY OF THE INVENTION

It is an object of the present invention to provide a writing instrument that overcomes the drawbacks of the prior art described above.

It is another object of the present invention to provide a writing instrument having a color indication-changeable grip in which the color, etc. exposed at a window portion of a gripping tube can easily be changed and customized as the user desires, and will not be changed when the writing instrument is subjected to vibration or shock after changing.

One aspect of the present invention is to provides a writing instrument having a color indication-changeable grip, comprising a barrel; plural identifying marks disposed in parallel in a circumferential direction at a front portion of the barrel and different in identification such as color, pattern or letters; a gripping tube rotatably held on the barrel and covering the identifying marks; a window portion formed on the gripping tube through which a part of the identifying marks appears; and locking means disposed between the gripping tube and the barrel for releasably locking the gripping tube in contact with the barrel.

Another aspect of the present invention is to provide a writing instrument having a color indication-changeable grip of the above structure, wherein the locking means comprises a locking pawl and a locking groove with which the locking pawl engages, and wherein the locking pawl is disposed at the side of one of the barrel or the gripping tube, the locking groove is disposed at the side of the other of the gripping tube or the barrel, and the locking pawl or the locking groove is disposed movably in a longitudinal direction of the barrel.

Another aspect of the present invention is to provide a writing instrument in which the gripping tube is held at the front portion of the barrel, and plural identifying marks providing different identifications such as color, pattern or letters, are arranged in parallel in the circumferential direction at the front portion of the barrel. The gripping tube is rotatably fitted on the barrel to cover the identifying marks and provided with a window portion through which a part of the identifying marks can be seen, and therefore when the gripping tube is rotated, the identification such as color which appears at the window portion can be changed as the user desires.

A further aspect of the present invention is to provide a writing instrument having locking means disposed between the gripping tube and the barrel for locking the gripping tube in releasable contact with the barrel, and therefore when the gripping tube stops at the rotated position, the gripping tube is locked and even if vibration or shock act on the writing instrument, the gripping tube will not rotate. Accordingly, the position of the window portion of the gripping tube and the position of identification such as color are not changed, and the customized state can be maintained.

A further aspect of the present invention is to provide a writing instrument having locking means which comprises a locking pawl and a locking groove with which the locking pawl releasably engages, and wherein the locking pawl is disposed at the side of the barrel or the gripping tube, the locking groove is disposed at the other of the side of the gripping tube or the barrel, and the locking pawl or the locking groove is disposed movably in a longitudinal direction of the barrel, whereby it is easy to release the locking means to let the gripping tube rotate by moving the locking pawl or the locking groove in the longitudinal direction of the barrel. Afterward, by returning the locking pawl or the locking groove to its original position, the gripping tube can easily be locked.

BRIEF DESCRIPTION OF THE DRAWINGS

FIGS. 3A-3D show a barrel of the writing instrument, wherein FIG. 3A is a plan view, FIG. 3B is a front view, FIG. 3C is a cross-sectional view, and FIG. 3D is a side view.

FIGS. 4A-4C show a gripping tube of the writing instrument, wherein FIG. 4A is a plan view, FIG. 4B is a front view, and FIG. 4C is a cross-sectional view.

FIGS. 5A-5D show a locking piece of a locking means of the writing instrument, wherein FIG. 5A is a plan view, FIG. 5B is a front view, FIG. 5C is a cross-sectional view, and FIG. 5D is a side view.

FIGS. 6A-6C are explanatory views of a writing instrument using the locking piece shown in FIGS. 5A-5D, wherein FIG. 6A is a plan view, FIG. 6B shows a state where the gripping tube is rotated, and FIG. 6C shows a state where the gripping tube is rotated 90 degrees.

FIGS. 7A-7C are explanatory views of a writing instrument using another example of the locking means, wherein FIG. 7A is a plan view, FIG. 7B shows a state where a tapered member is loosened and the gripping tube is rotated, and FIG. 7C shows a state where the gripping tube is rotated 90 degrees.

FIGS. 8A-8D show the relation of a gripping tube, identifying marks, a locking groove and a locking pawl, wherein FIG. 8A is an exploded view of the gripping tube, FIG. 8B is an exploded view of the identifying marks, FIG. 8C is an exploded view of a grip when the gripping tube is located at its fixed position, and FIG. 8D is an exploded view of the grip when the grip is rotated 90 degrees from its fixed position.

FIGS. 9A-9D show other examples of the gripping tube, wherein FIG. 9A to FIG. 9D show gripping tubes having window portions of different configurations.

FIGS. 10A-10C show a color piece, wherein FIG. 10A is a plan view, FIG. 10B is a cross-sectional view, and FIG. 10C is a side view.

FIGS. 11A-11B show a barrel to which the color piece is attached, wherein FIG. 11A is a plan view and FIG. 11B is a partial cross-sectional view.

FIG. 12A-12D show a gripping tube to be combined with the color piece, wherein FIG. 12A is a plan view, FIG. 12B is a partial cross-sectional view, FIG. 12C is a right-hand side view, and FIG. 12D is a left-hand side view.

FIGS. 15A-15D show a locking color piece, wherein FIG. 15A is a plan view, FIG. 15B is a front view, FIG. 15C is a cross-sectional view, and FIG. 15D is a side view.

FIGS. 16A-16B show a barrel to which the locking color piece is attached, wherein FIG. 16A is a plan view and FIG. 16B is a partial cross-sectional view.

FIGS. 17A-17D show a gripping tube to be combined with the locking color piece, wherein FIG. 17A is a plan view, FIG. 17B is a cross-sectional view, FIG. 17C is a right-hand side view, and FIG. 17D is a left-hand side view.

DETAILED DESCRIPTION OF THE PREFERRED EMBODIMENTS

Figure 1:
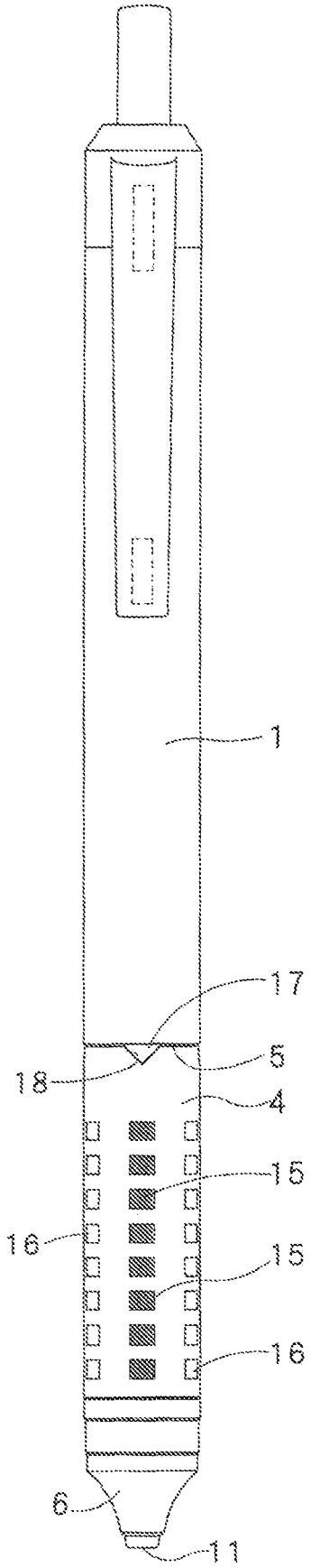
FIG. 1 is a front view showing an embodiment of a writing instrument constructed according to the principles of the present invention.
Figure 2:
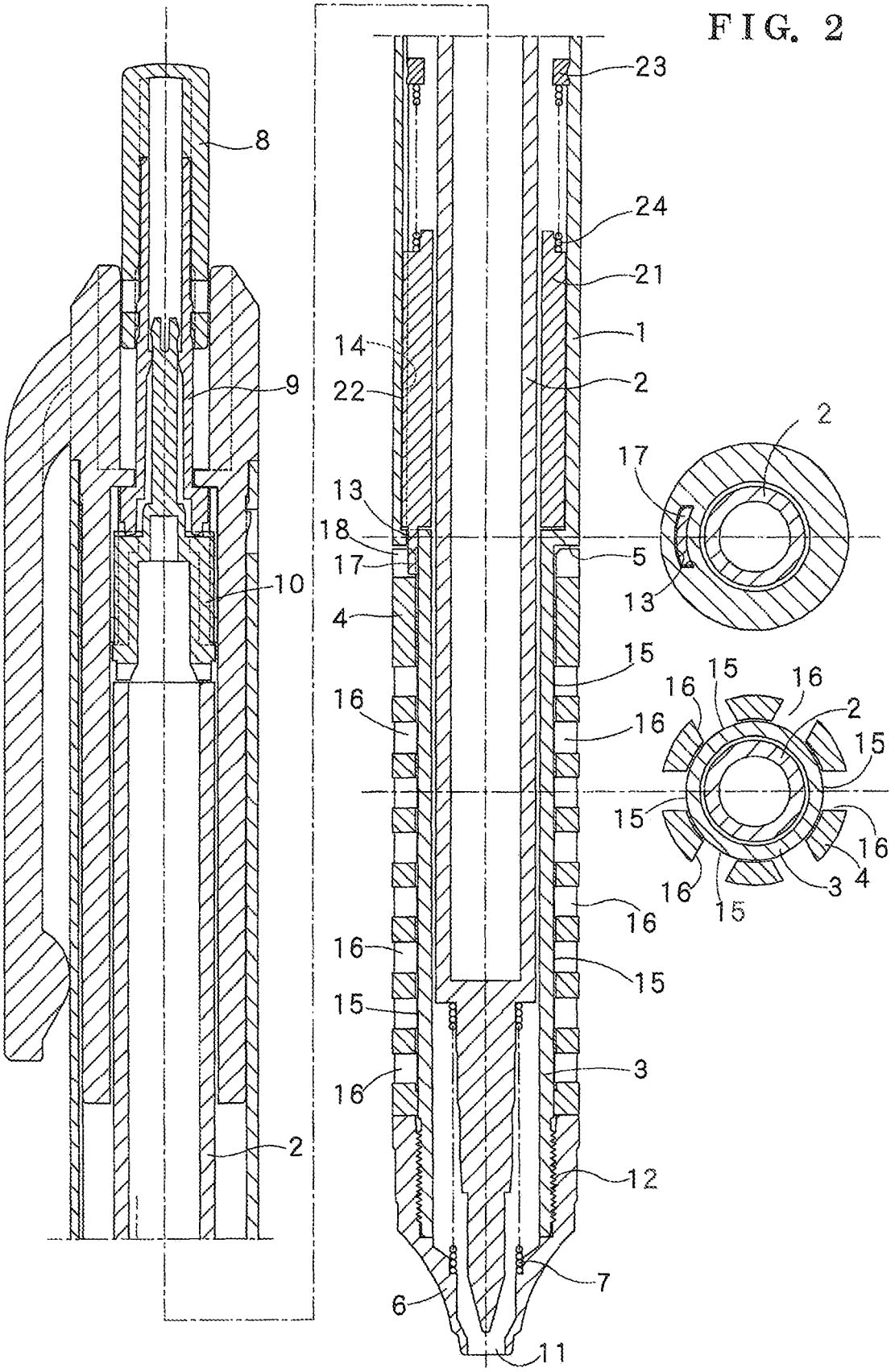
FIG. 2 is an enlarged cross-sectional view of the writing instrument shown in FIG. 1.
Figure 3:
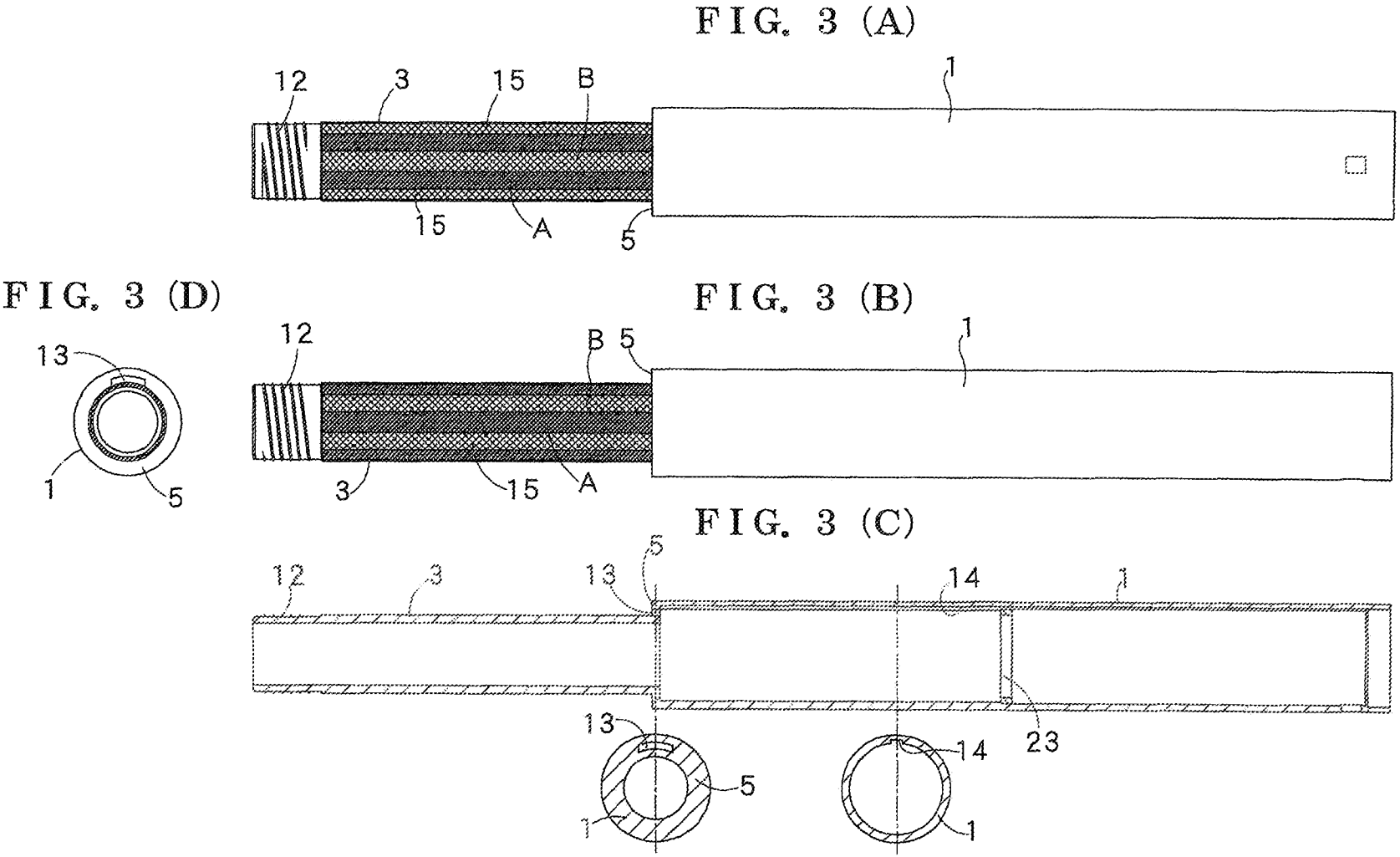

FIGS. 1-2 show one embodiment of a writing instrument according to the present invention. In this embodiment, the writing instrument is a ball point pen housing a ball point pen refill 2 in a barrel 1 is shown, but it may be a writing instrument housing a writing member in a barrel such as a mechanical pencil or a marker pen, or a suitable cosmetic make-up tool. At a front portion 3 of the barrel 1, a grip is provided by rotatably fitting a gripping tube 4 thereon. The gripping tube 4 is inserted from a front end side of the barrel 1 up to the position where a rear end of the gripping tube 4 abuts on a stepped portion 5 formed on the barrel 1 as shown in FIG. 3, and by, for example, threadedly attaching a tapered member 6 at the front end of the barrel, the gripping tube 4 is kept in such a state that it is sandwiched between the stepped portion 5 and the tapered member 6. In the embodiment shown in FIG. 2, the ball point pen refill 2 is urged in a rearward direction of the barrel 1 by a knock spring 7, and the front end of the ball point pen refill 2 is protruded for writing from a front end opening 11 of the tapered member 6 by pushing a knock cap 8 by use of a known rotary-type feeding mechanism including the knock cap 8, a knock cam 9, a rotor 10, etc.

As shown in FIGS. 2-3, the barrel 1 has the front portion 3 formed in a small diameter, and the gripping tube 4 is rotatably fitted onto the small diameter portion. At the rear end of the small diameter portion, the stepped portion 5 is formed on which the rear end of the gripping tube 4 abuts, and at the front end side of the small diameter portion, a thread portion 12 is formed on which the tapered member 6 is threadedly engaged. Further, at the side face wall of the stepped portion 5, a through-hole 13 which opens in the longitudinal direction of the barrel 1 is formed, and on the inner face of the barrel 1, a guide groove 14 extending in the longitudinal direction is formed.

On the surface of the front portion 3 between the stepped portion 5 and the thread portion 12, plural identifying marks 15 which are different in their manner of identification, such as color, pattern or letters, are disposed in parallel in the circumferential direction. That is, the identifying marks 15 have different identification characteristics (color, pattern, letters, etc.) that distinguish the different identifying marks from one another. The identifying marks may, as in this example, extend lengthwise in longitudinal rows which are circumferentially spaced apart from one another. The identifying marks 15 are formed by an appropriate means such as printing, decal tape, masking tape, etc. and extend throughout the entire length in the longitudinal direction of the front portion 3 of the barrel 1.

Figure 8:
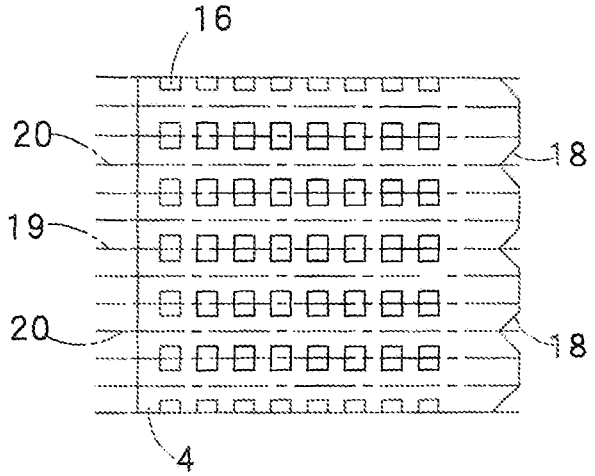
Figure 8:
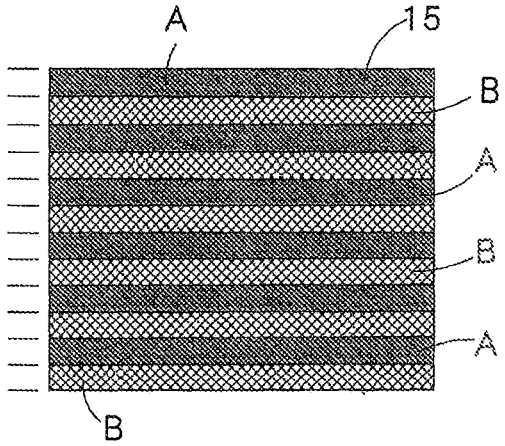
Figure 8:
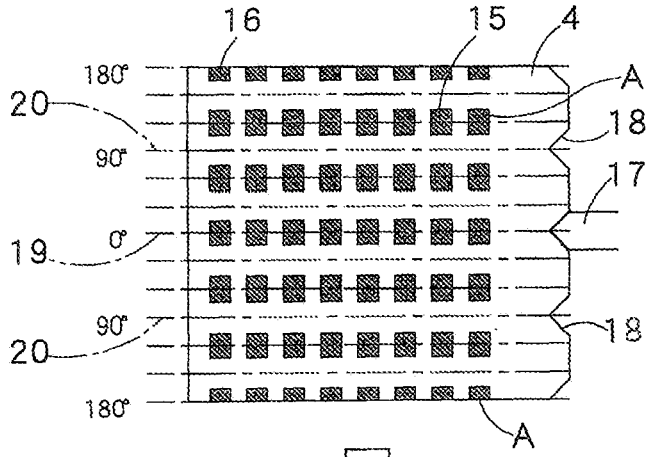
Figure 8:
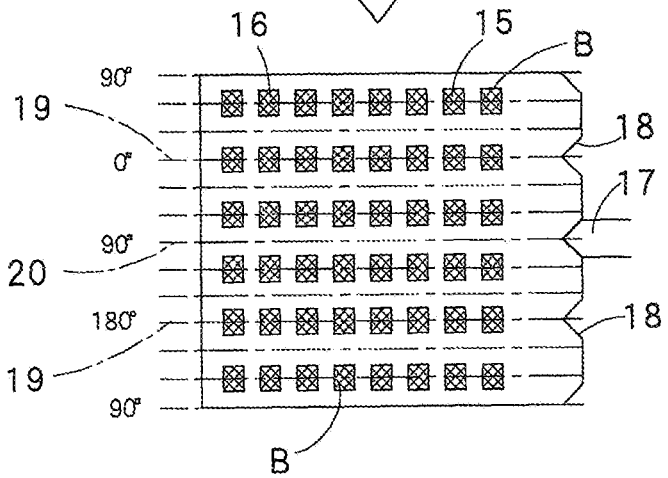

The identifying marks may be arranged in any desired pattern or configuration. For example, identifying marks 15 with different lengths in the longitudinal direction may be combined in an appropriately different style, disposed intermittently, or disposed in an inclined style in a slantwise direction. The identifying marks 15 may preferably be arranged in color so that adjoining identifying marks are different colors, etc. in the circumferential direction, and in the example shown in FIG. 3, as shown in the exploded view of FIG. 8B, the color A and the color B are arranged to alternately appear at every 30 degrees. As other structures of arrangement, for example, the entire circumference may be divided into plural divisions, and then entire divisions may be formed in completely different colors, etc., or classified into several divisions in which identification such as color would appear repeatedly, or may be freely constructed in an appropriate arrangement of colors abounding in variety.

Figure 4:
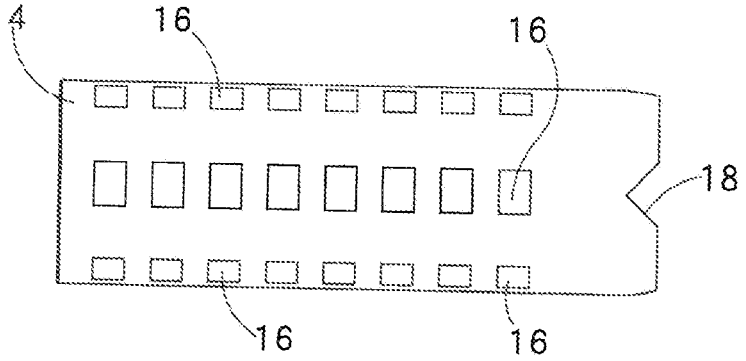
Figure 4:
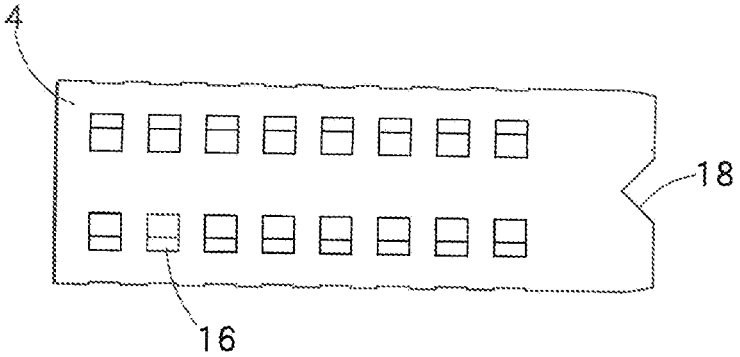
Figure 4:
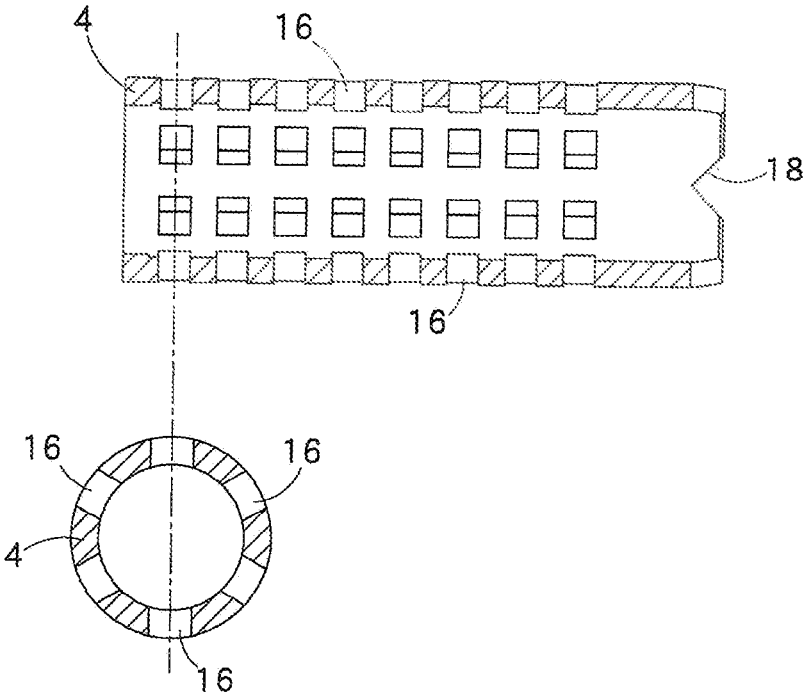

The gripping tube 4 is formed in a cylindrical shape, and as shown in FIG. 4, plural window portions 16 are formed in parallel in the longitudinal direction at the positions corresponding to the identifying marks 15. In this example, the window portions 16 are disposed in parallel in the circumferential direction as well, and as the arrangement in the circumferential direction, in the example shown in this view, the window portions are disposed so that a center line 19 in the longitudinal direction of the window portions 16 would be located at every 60 degrees as shown in the exploded view of FIG. 8A. The window portions 16 are formed as openings made by cutting away portions of the wall of the cylindrical gripping tube made of a metallic material as shown in the example of FIG. 4, but may be formed as closed window portions having transparency by constructing the gripping tube 4 out of plastic material.

Figure 9:
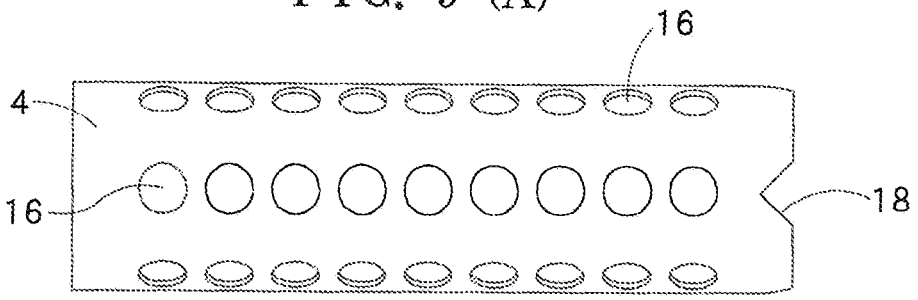
Figure 9:
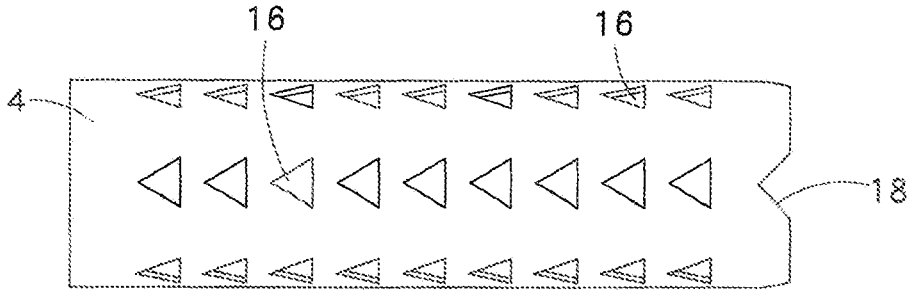
Figure 9:
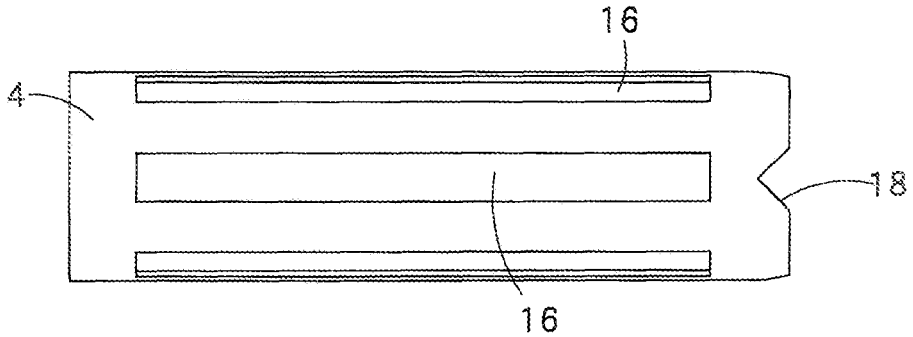
Figure 9:
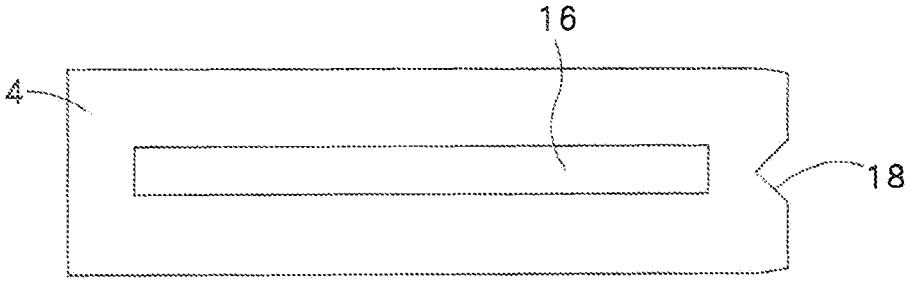
Figure 10:
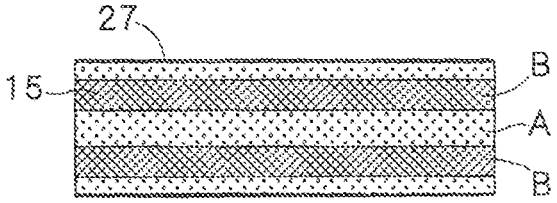
Figure 10:
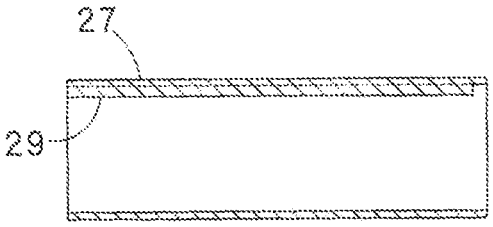
Figure 10:
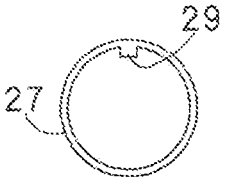
Figure 11:
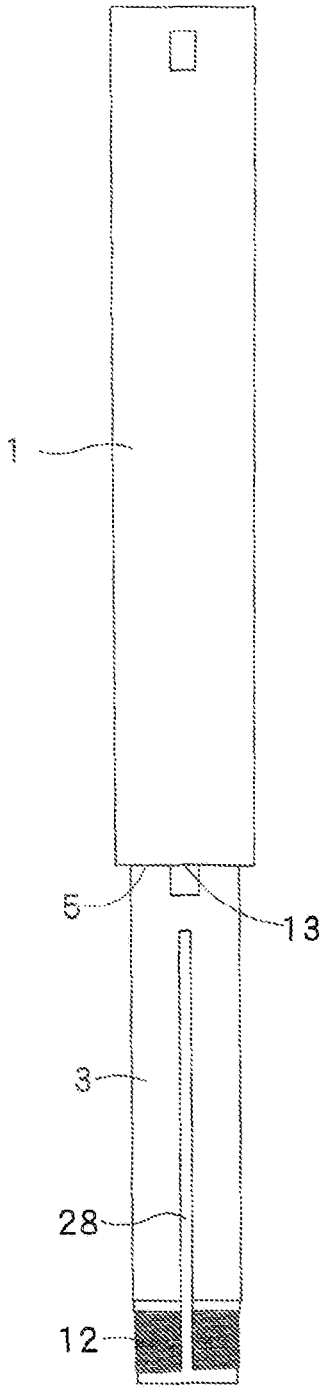
Figure 11:
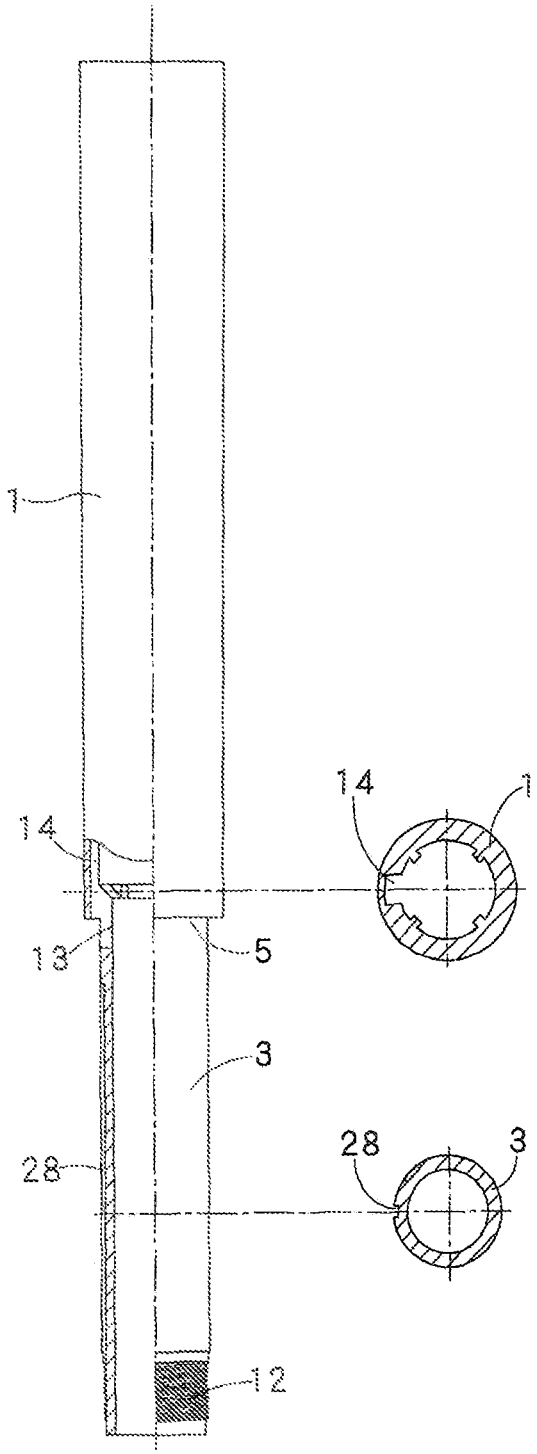
Figure 12:
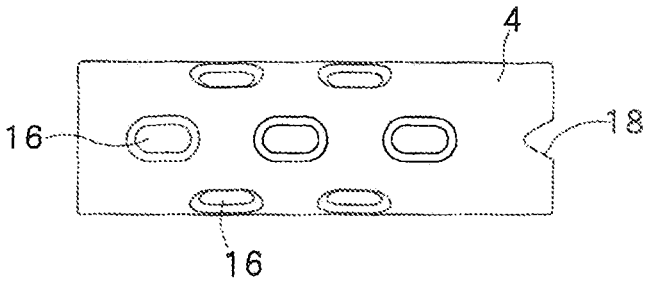
Figure 12:
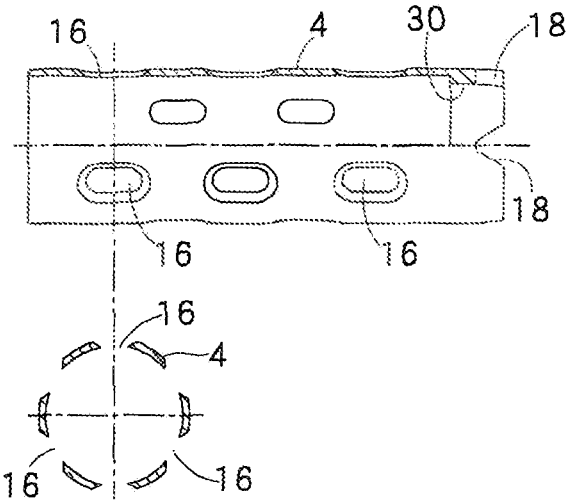
Figure 12:
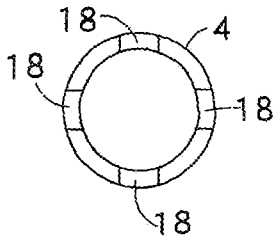
Figure 12:
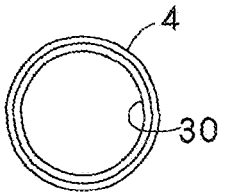

The window portions 16 are formed in a rectangular shape in the embodiment shown in FIG. 1, but may be formed in other appropriate shapes as the case requires. For example, the window portions may be formed in a circular shape as shown in FIG. 9A, in a triangular shape as shown in FIG. 9B, in a rectangular shape in the longitudinal direction as shown in FIG. 9C, or in another appropriate shape. Here, without arranging plural window portions in parallel in the circumferential direction, a structure as shown in FIG. 9D may be employed in which only one window portion 16 of rectangular or other shape is formed at one place in the longitudinal direction and the remaining outer periphery of the gripping tube 4 except for the window portion is closed or opaque. With this structure, by disposing plural identifying marks of different colors, etc. in respective circumferentially-spaced divisions around the barrel 1, when the gripping tube 4 is turned, successive divisions pass beneath the single window portion and it is possible to see one by one all the colors, etc. through the single window portion.

Between the gripping tube 4 and the barrel 1, a locking means is disposed to releasably lock the gripping tube 4 in a desired angular position on the gripping tube 4. The locking means preferably comprises a locking pawl 17 on the gripping tube releasably engageable with a locking groove 18 formed in the barrel 1. In the embodiment shown in FIGS. 1-2, plural locking grooves 18 are disposed in circumferentially spaced relation around the side of the gripping tube 4, and the locking pawl 17 is disposed at the side of the barrel 1. As the structure of the locking pawl and the locking groove, an appropriate structure is employed in which at ordinary times, the locking pawl releasably engages with the locking groove to detachably connect the gripping tube to the barrel side so that the gripping tube will not rotate. When the gripping tube 4 is forcefully rotated relative to the barrel 1, the locking pawl 17 and/or the locking groove 18 moves rearward in the longitudinal direction of the barrel and the locking pawl 17 disengages from the locking groove 18 so that the connection between the locking pawl and the barrel can be detached. As such structure, for example, projections or grooves of a conical shape or a wave shape, or irregular-shaped projections continuously winding like a saw-teeth shape, may be used.

In the embodiment shown in FIG. 1, the locking groove 18 opens rearwardly in a substantially V-shape at the rear end of the gripping tube 4. Preferably a plurality of locking grooves 18 are disposed at circumferentially spaced locations at the rear end of the gripping tube 4 as shown in FIG. 4. The locking pawl 17 is a projection having a front end which protrudes in a conical shape as shown in FIG. 5.

The distance between the locking grooves 18 to be disposed in the circumferential direction is determined based on the position in rotation at which the gripping tube 4 is to be locked. In the example of FIG. 4, in order to lock the gripping tube 4 at every 90 degrees, the locking grooves 18 are disposed with such a distance that the inward front end of each locking groove 18 is located at a portion where it is placed on the center line 19 in the longitudinal direction row of the window portions 16, and a portion where the gripping tube 4 rotates 90 degrees and it is located on a center line 20 in the longitudinal direction row of the window portions 16, as shown in the exploded view in FIG. 8A.

Figure 5:
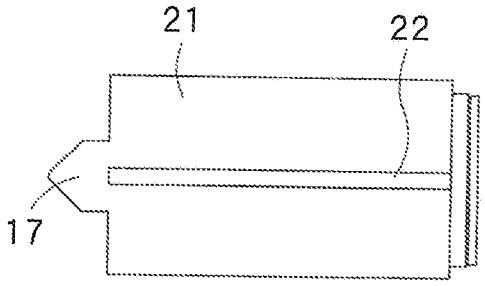
Figure 5:
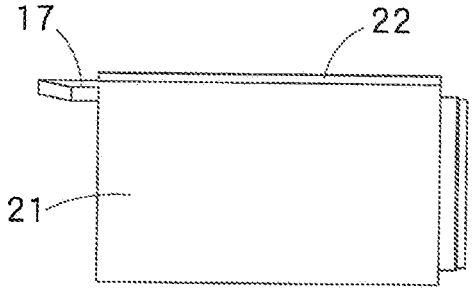
Figure 5:
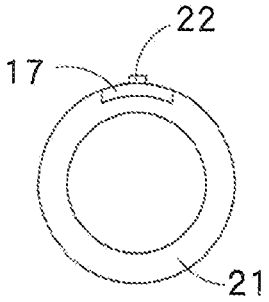
Figure 5:
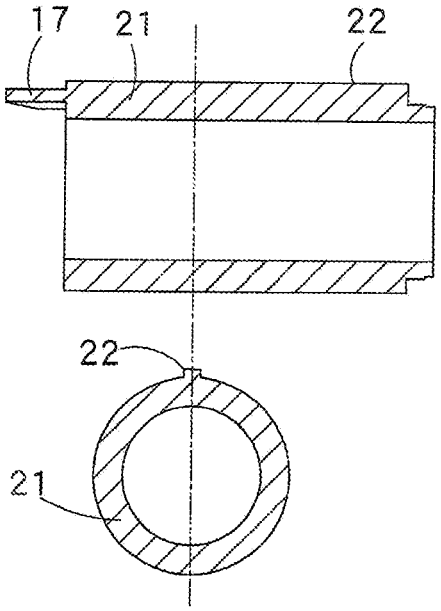

As shown in FIG. 5, the locking pawl 17 protrudes in a conical shape from the front end of a locking piece 21. The locking piece 21 has a positioning projection 22 extending in the longitudinal direction on its peripheral surface, and the locking piece 21 is movably housed in the barrel so that the positioning projection 22 can move forward and rearward in a state where it is slidably engaged with the guide groove 14 disposed in the barrel 1. As shown in FIG. 2, between the rear portion of the locking piece 21 and a receiving portion 23 disposed within the barrel 1, a lock spring 24 is disposed to urge the locking piece 21 in such a direction that the front end of the locking pawl 17 is protruded forward from the through hole 13 disposed at the stepped portion 5 of the barrel 1, by which the locking pawl 17 is made to elastically abut on the rear end of the gripping tube 4.

Figure 6:
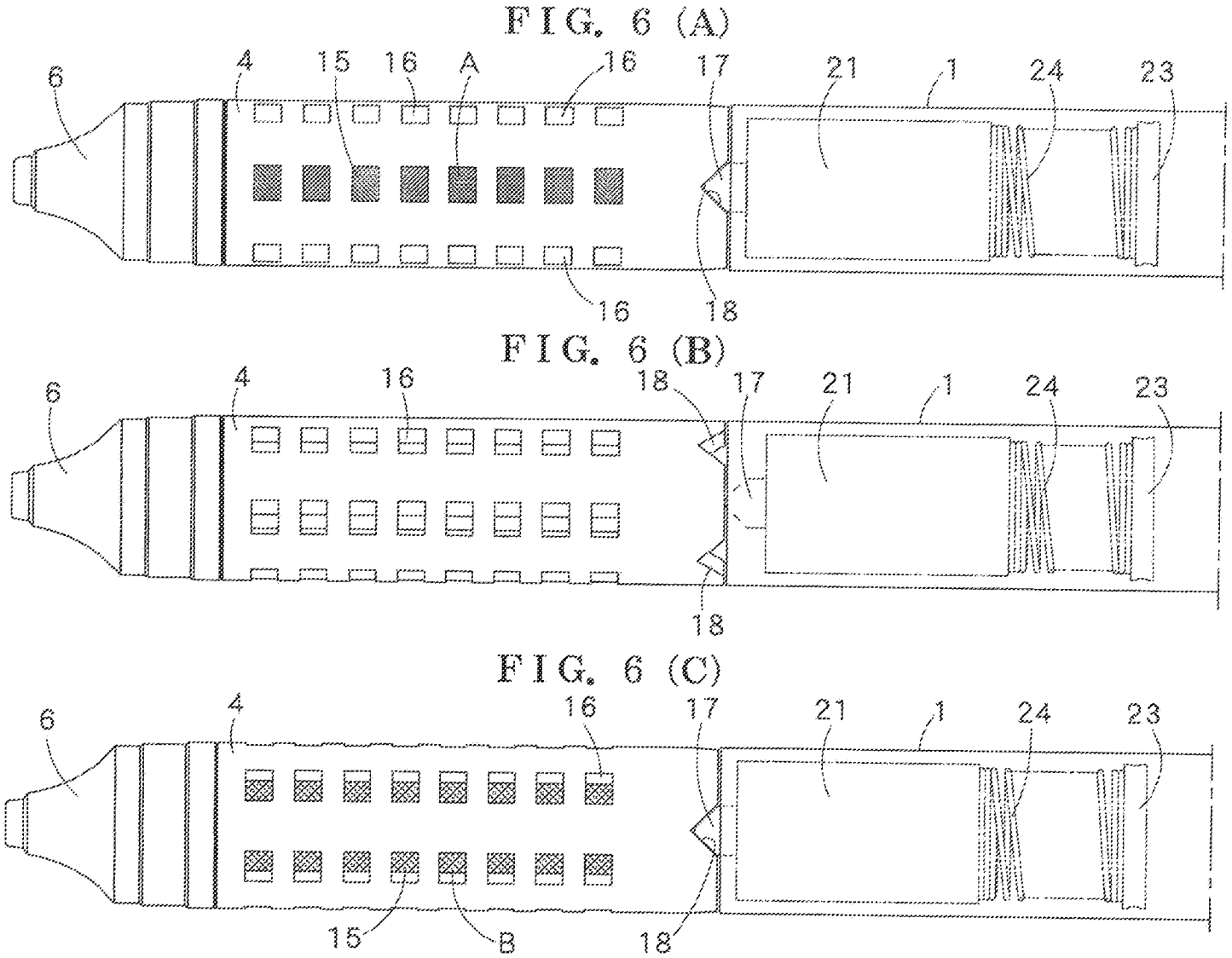

With reference to FIG. 6A, when the gripping tube 4 is located at its ordinary position, the locking pawl 17 is engaged with the locking groove 18, whereby the gripping tube is kept in a locked state. When the gripping tube 4 is rotated strongly, as shown in FIG. 6B, the side face of the substantially V-shaped locking groove 18 presses the side face of the substantially conical-shaped locking pawl 17 in a camming action, whereby the locking piece 21 on which the locking pawl 17 is formed can be moved backward while thrusting the locking piece 21 against the locking spring 24. As a result, the locking pawl 17 can slip out of the locking groove 18 to release the locked state, whereby the gripping tube 4 having the locking groove 18 formed thereon can be freely rotated. When the gripping tube 4 rotates up to the position corresponding to a position where the adjoining next locking groove 18 faces the locking pawl 17, the locking piece 21 having the locking pawl 17 formed thereon is urged forward by the locking spring 24 and the locking pawl 17 engages with the locking groove 18, whereby the gripping tube 4 is kept at this position as shown in FIG. 6C.

In this example, the locking groove 18 is disposed at the side of the gripping tube 4 and the locking pawl 17 is disposed at the side of the barrel (locking piece 21). However, the locking pawl may be disposed at the side of the gripping tube and the locking groove may be disposed at the side of the barrel (locking piece 21). Here, in a case where the locking pawl is rotated, it is preferred to form an appropriate guide face, etc. for guiding the locking pawl to the locking groove on the outer face of the member constituting the locking groove (not shown).

In the above example, the locking piece having the locking pawl disposed thereon is disposed movably in the longitudinal direction of the barrel. However, a gripping tube having a locking piece disposed thereon may be disposed movably in the longitudinal direction of the barrel, or a locking piece and a gripping tube may be disposed movably in the longitudinal direction of the barrel.

Figure 7:
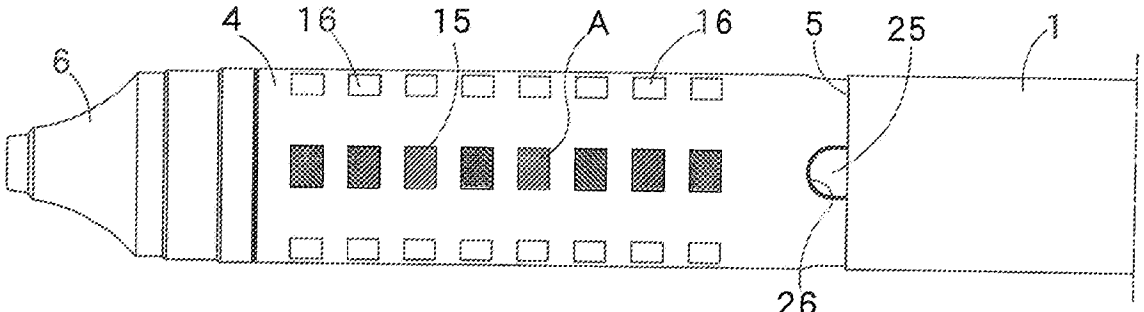
Figure 7:
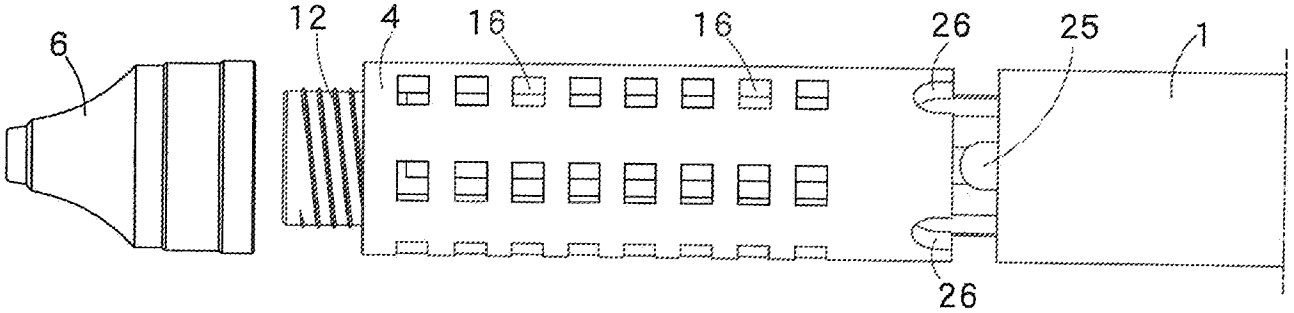
Figure 7:
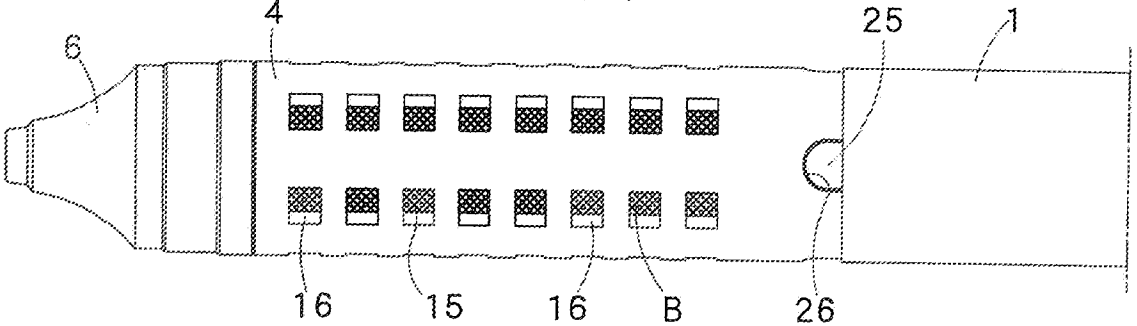

FIGS. 7A-7C show another example of a locking means having a gripping tube disposed movably in the longitudinal direction of the barrel. In this example, on the inner face wall of the stepped portion 5 of the barrel 1, a locking pawl 25 having a front end of a substantially semi-circular shape protrudes against the side of the gripping tube 4, and at the rear end of the gripping tube 4, a locking groove 26 of a substantially semi-arcuate shape is disposed with which the locking pawl can engage.

The tapered member 6 is preferably disposed detachably from the barrel 1 so that the gripping tube 4 can easily be moved in the longitudinal direction of the barrel. In this example, as shown in FIG. 7A, in a state where the locking groove 26 of the gripping tube 4 engages with the locking pawl 25 of the barrel 1, the gripping tube 4 is in a locked state and kept at its ordinary position. As shown in FIG. 7B, when the tapered member 6 is detached or when the tapered member is loosened so that the gripping tube 4 can move forward in the longitudinal direction to such an extent that the locking groove 26 slips out of the locking pawl 25, the arcuate outer face of the locking pawl slidably slips out of the arcuate inner face of the locking groove 26 and the locked state is released, whereby the gripping tube 4 can be rotated. When a desired identifying mark 15 appears in the window portion 16, the gripping tube 4 is returned to the original position and the locking groove 26 again engages with the locking pawl 25, whereby the gripping tube 4 is locked as shown in FIG. 7C. In FIG. 7B, the tapered member is detached from the barrel for the sake of explanation, but if the gripping tube can be rotated, the tapered member may not be detached. Here, in this example as well, the locking pawl may be disposed at the side of the gripping tube and the locking groove may be disposed at the side of the barrel.

As mentioned above, the rows of the window portions 16 of the gripping tube 4 in the longitudinal direction are arranged so that the center lines 19 of adjacent rows in the longitudinal direction are spaced apart a distance corresponding to 60 degrees as shown in the exploded view of FIG. 8A. Further, the identifying marks 15 are indicated with color A and color B repeatedly at every 30 degrees as shown in the exploded view of FIG. 8B. At the rear end face of the gripping tube, the locking grooves 18 are disposed so that they are located at every 90 degrees.

Next, explanation will be made on an assumption that the locking pawl 17 is located along the center line 19 in the rows in the longitudinal direction of the central window portions 16 and this position is set to be an ordinary position as shown in the exploded view of FIG. 8C, and the color A is visually recognized through the window portions 16 of the gripping tube 4 in this condition. This condition is represented by FIG. 6A and FIG. 7A. When the gripping tube is rotated 90 degrees from this condition, the rotated position is seen in the exploded view of FIG. 8D, and the locking pawl 17 engages with the locking groove 18 placed just on the center line 20 between the rows in the longitudinal direction of the window portions 16, whereby the rotation of the gripping tube 4 is locked. At this moment, the color B is visually recognized through the window portions 16 of the gripping tube 4. This condition is shown in FIG. 6C and FIG. 7C.

As explained above, by rotating the gripping tube 4 by 90 degrees, the color, etc. displayed in the window portions 16 can be changed, and by appropriately setting the position of the identifying marks 15 and the window portions 16 of the gripping tube 4, the colors, etc. can be changed one after another for customization. At the position where the selected color, etc. is visible, the gripping tube 4 is locked by the locking means and will not be changed even if the writing instrument is subjected to vibration or shock. In the above example, the gripping tube is set to be locked upon rotation at every 90 degrees, and this rotation degree can be appropriately set, for example, at 45 degrees, 60 degrees, or the like, and the identifying marks, the position of the window portions of the gripping tube, the locking groove, the locking pawl, etc. may be arranged based on the rotation degree. Further, as the identifying marks, lead hardness, lead diameter, etc. of mechanical pencils may be indicated, or one's names such as individual person names, nicknames, initials or other names may be printed, so that such identification can be seen through the window portions.

In the above example, the identifying marks are directly disposed by printing, decal tape, masking tape, etc. on the surface of the front portion of the barrel, but other than the barrel, it is possible to prepare a tubular member having identifying marks disposed on its outer surface and incorporate this member into the barrel. FIGS. 10-19 show examples of such tubular members.

FIG. 10A-10C show a color piece 27 in the form of a tubular member having an inner diameter and an outer diameter and being configured and dimensioned to be removably attached between a gripping tube and the front portion of a barrel of a writing instrument. Identifying marks 15 such as color marks A and B are alternately arranged in parallel in the circumferential direction on the outer surface of the tubular member by printing, decal tape, masking tape, etc. In the following examples, parts which are the same or similar to parts illustrated in FIGS. 1-9 are identified by the same reference numerals.

As mentioned above, by forming a color piece 27 separate from the barrel, and disposing identifying marks 15 on the color piece 27, it is possible to improve the productivity as compared to the case where the identifying marks 15 are directly disposed on the barrel 1, thereby lowering the overall cost of production. In addition, purchasers of the writing instruments can easily attach his or her preferred identifying marks by affixing pre-marked decal tape, masking tape, etc. and therefore highly customized writing instruments can be obtained.

When the color piece 27 is incorporated in a writing instrument, an appropriate attachment structure may be used. FIG. 11A to FIG. 14 show an example wherein at the stepped portion 5 where the barrel 1 transitions to the small-diameter front portion 3 (FIGS. 11A-11B), in substantially the same manner as in the above-described examples, a through-hole 13 is formed for insertion of a locking pawl 17 of a locking piece 21 housed movably in the longitudinal direction within a barrel 1. On the inner face of the barrel 1 behind the stepped portion 5, a guide groove 14 is disposed and in the guide groove is fitted a positioning projection 22 which projects from the locking piece 21 for preventing rotation of the locking piece 21.

As shown in FIGS. 11A-11B, on the outer face of the front portion 3 of the barrel 1, a rotation-preventing groove 28 is formed, and the front end of the rotation-preventing groove opens in the forward direction. A rib 29 (see FIGS. 10A-10B) disposed on the inner face of the color piece 27 engages with the rotation-preventing groove 28, whereby the color piece 27 is attached to the barrel in a rotation-prevented state. The gripping tube 4 has plural window portions 16 arranged in lines in the longitudinal direction in the same manner as in the above examples, as shown in FIGS. 12A-12C, and in its inside, a shoulder portion 30 (FIGS. 12B-12C) is provided to sandwich the front and rear ends of the color piece 27 attached to the barrel between the shoulder portion 30 and the tapered member 6. Plural locking grooves 18 are provided at the rear end of the gripping tube 4.

Figure 13:
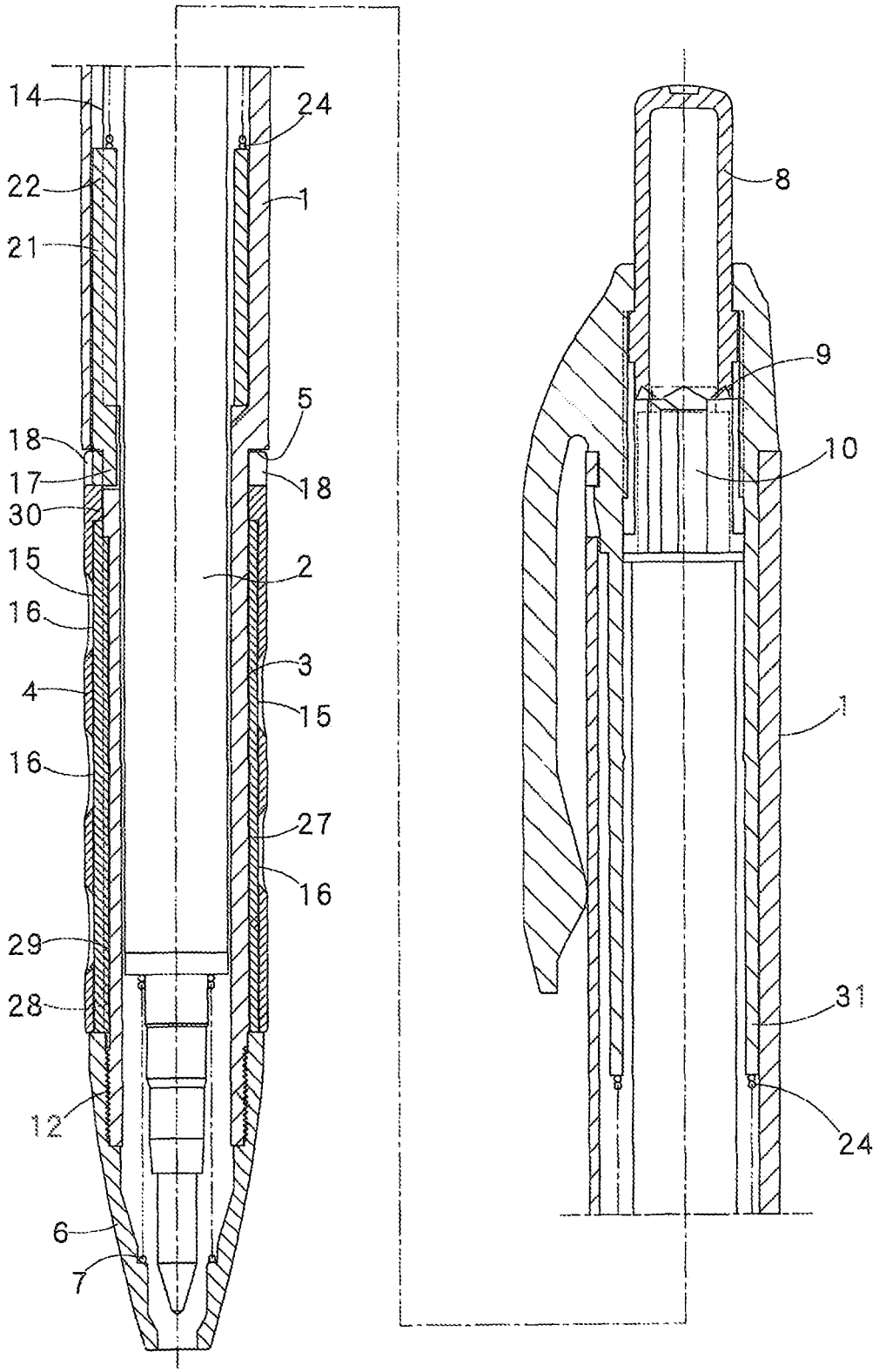
FIG. 13 is an enlarged cross-sectional view of an embodiment of a writing instrument using the color piece according to the present invention.
Figure 14:
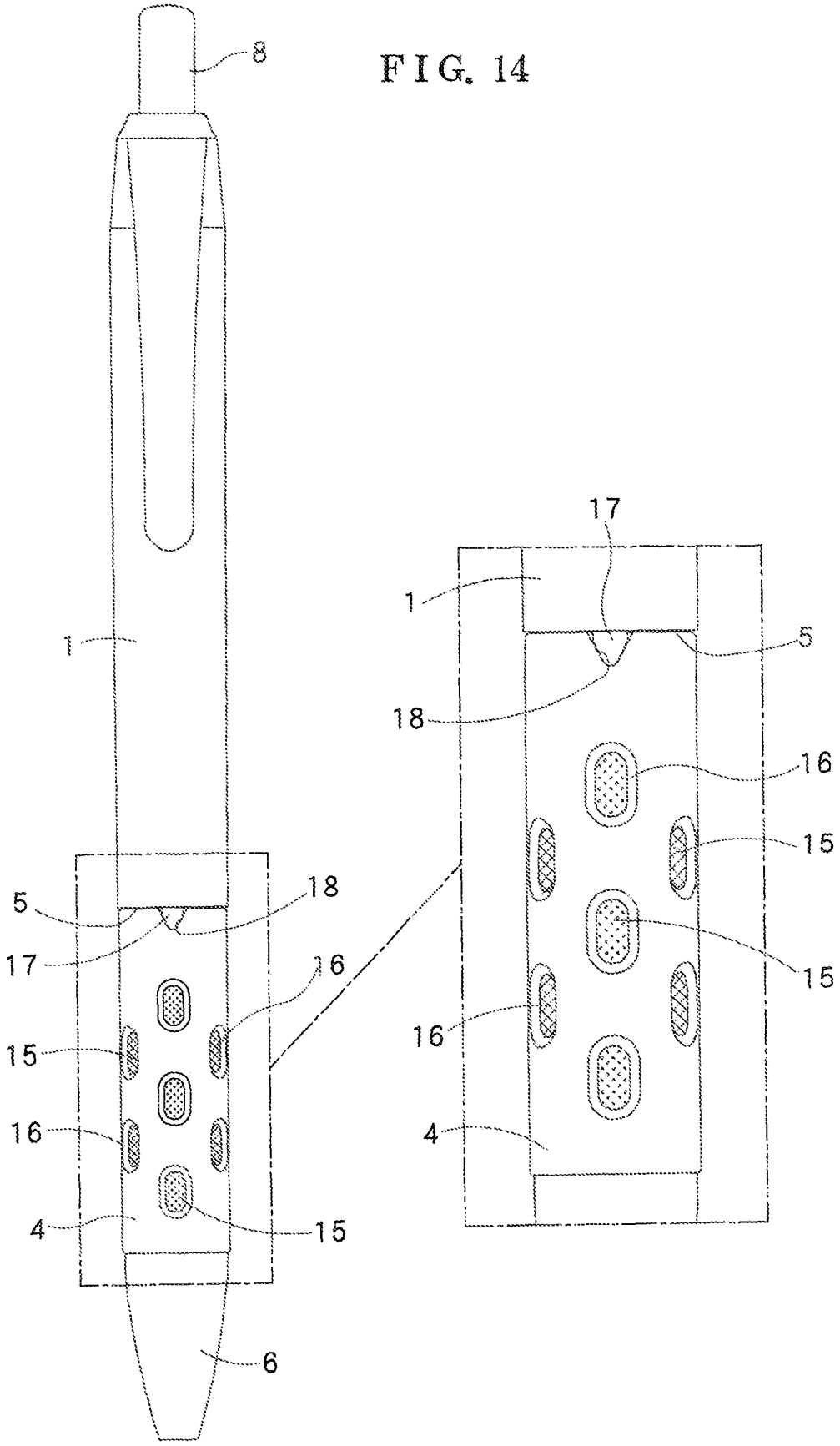
FIG. 14 is a front view of a writing instrument using the color piece.
Figure 15:
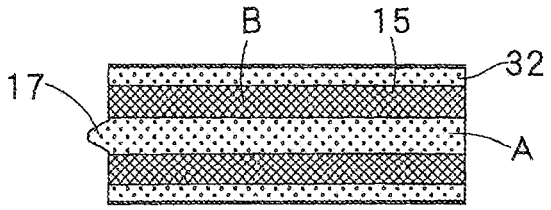
Figure 15:
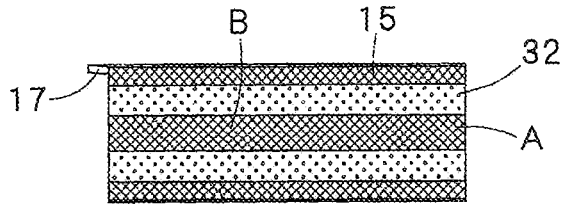
Figure 15:
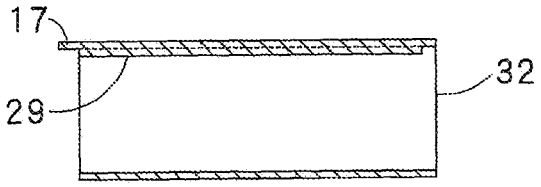
Figure 15:
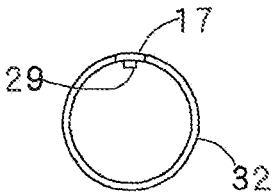

One embodiment of a writing instrument using the locking piece 21 is illustrated in FIG. 13. As shown in FIG. 13, the front end of the locking spring 24 abuts on the rear end of the locking piece 21 and the rear end of the locking spring 24 abuts on the front end of a gripping inner tube 31 inserted into the barrel. By this arrangement, the locking piece 21 is urged forward and the locking pawl 17 elastically abuts on the rear end of the gripping tube 4. Accordingly, in the same manner as in the embodiment shown in FIGS. 1-2, by strongly rotating the gripping tube 4 sandwiched between the tapered member 6 and the stepped portion 5 to release the locked state, although the color piece 27 does not rotate, the locking groove 18 rotates while moving the locking piece 21 having the locking pawl 17 formed therein backward against the locking spring 24. When the next locking groove 18 faces the locking pawl 17, the locking piece 21 moves forward by the action of the locking spring 24, whereby the next locking groove 18 engages with the locking pawl 17, and as shown in FIG. 14, the gripping tube 4 can be locked at such a position that a change of position is seen in the identifying marks 15 such as color of the color piece 27 as visually recognized through the window portions 16.

In the embodiment shown in FIG. 13, etc., the locking piece 21 and the color piece 27 are separate elements and are separately disposed, but a locking color piece 32 having both the function of the locking piece and the function of the color piece may be used without separately disposing the locking and color pieces.

Figure 16:
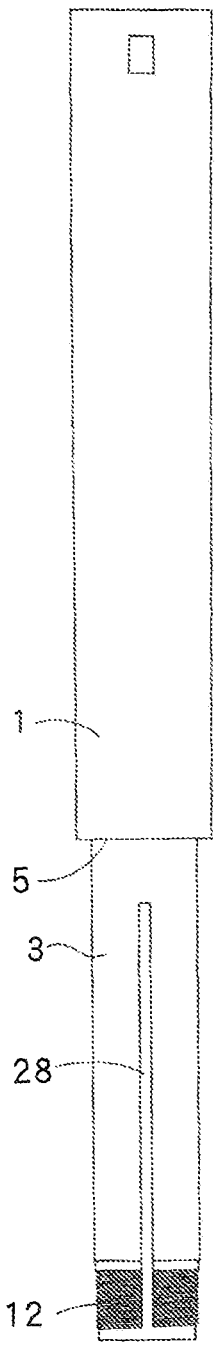
Figure 16:
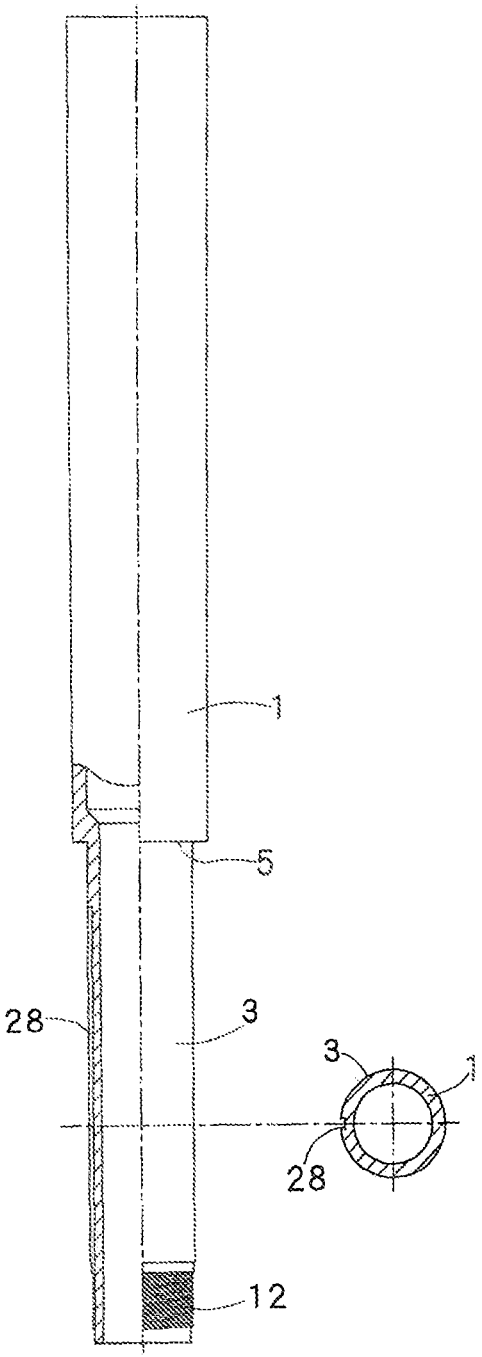
Figure 17:
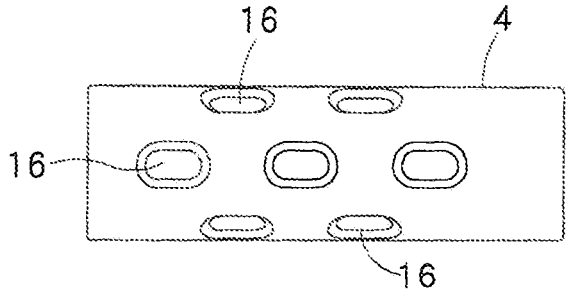
Figure 17:
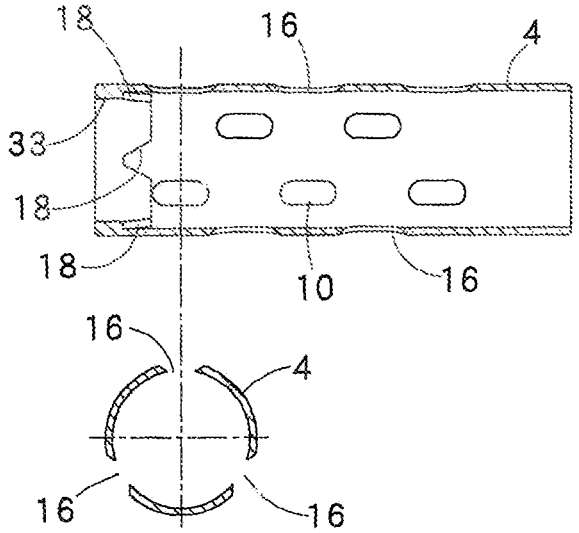
Figure 17:
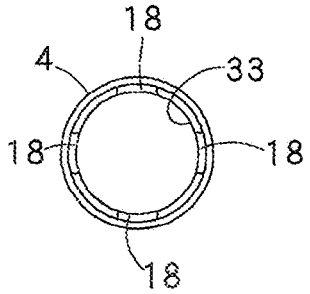
Figure 17:
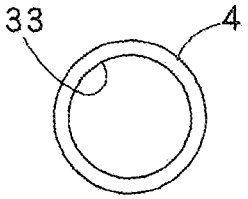

FIGS. 15A-15D show one example of the locking color piece 32. On the outer surface of the locking color piece 32, identifying marks 15 are disposed in parallel in the circumferential direction by use of printing, decal tape, masking tape, etc., and on the front end of the locking color piece 32, a locking pawl 17 protrudes in the forward direction. A rib 29 is provided on the inner surface of the locking color piece 32 (FIGS. 15C-15D) and extends lengthwise in alignment with the locking pawl 17. The rib 29 is slidably mounted in a rotation-preventing groove 28 formed at the front portion 3 of the barrel 1 as shown in FIG. 16. By this arrangement, the locking color piece 32 can undergo sliding movement in the longitudinal direction in the rotation-preventing groove 28 while in a rotation-prevented state. The rotation-preventing groove 28 is formed between the stepped portion 5 of the barrel 1 and the rear end of the locking color piece 32, and a locking spring 24 (see FIG. 18) is disposed between the stepped portion 5 and the rear end of the locking color piece 32 to urge the locking color piece forward.

Figure 18:
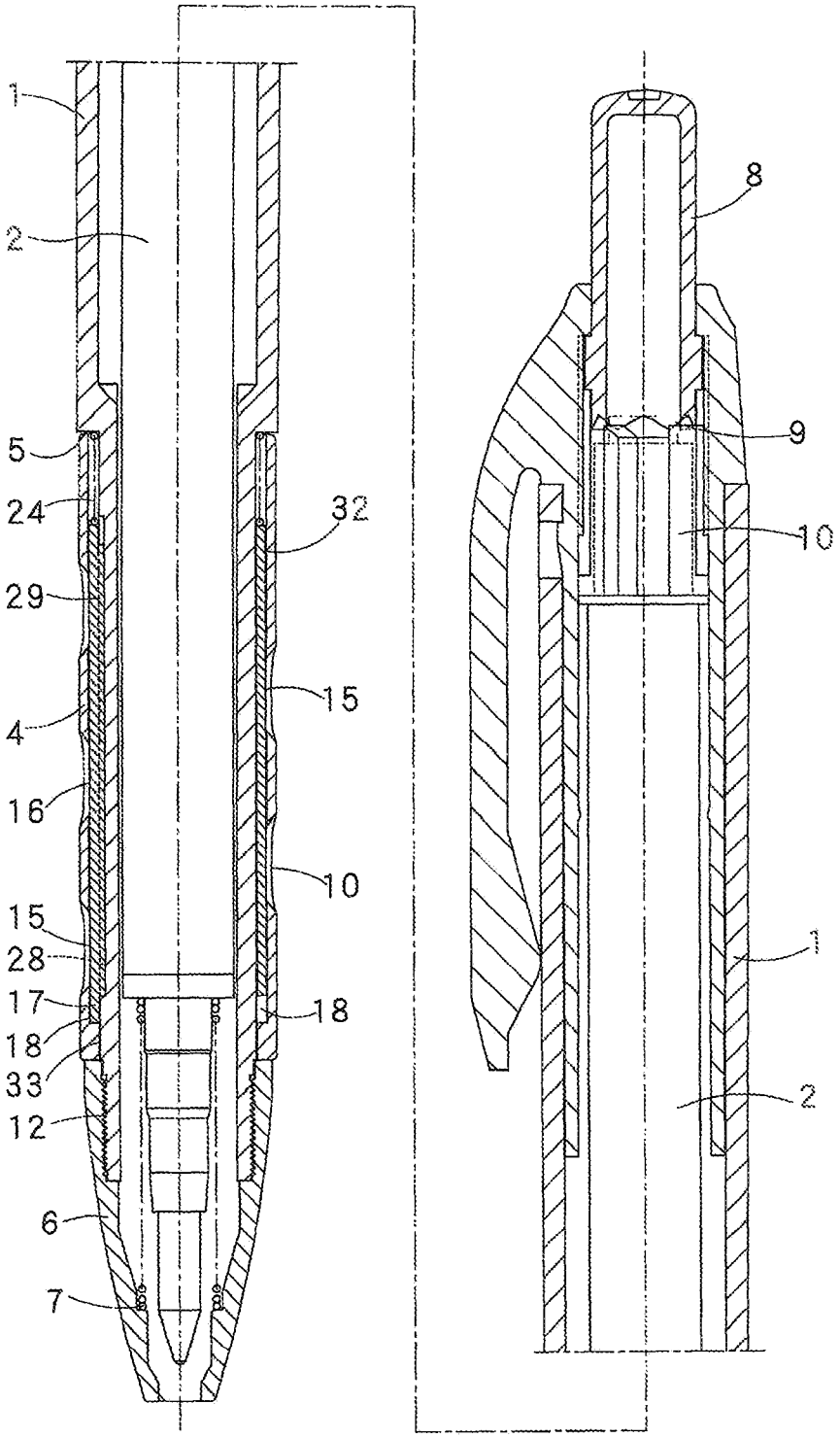
FIG. 18 is an enlarged cross-sectional view of an embodiment of a writing instrument using the locking color piece according to the present invention.

FIG. 18 shows an embodiment of a writing instrument incorporating the locking color piece 32. As shown in FIG. 18, the gripping tube 4 has an inner diameter configured to house therein the locking color piece 32, and at its front portion, as shown in FIGS. 17B-17D, an inwardly protruding portion 33 is disposed on which the front end of the locking color piece 32 abuts, and at the inwardly protruding portion 33, plural locking grooves 18 are formed to engage with the locking pawl 17.

Figure 19:
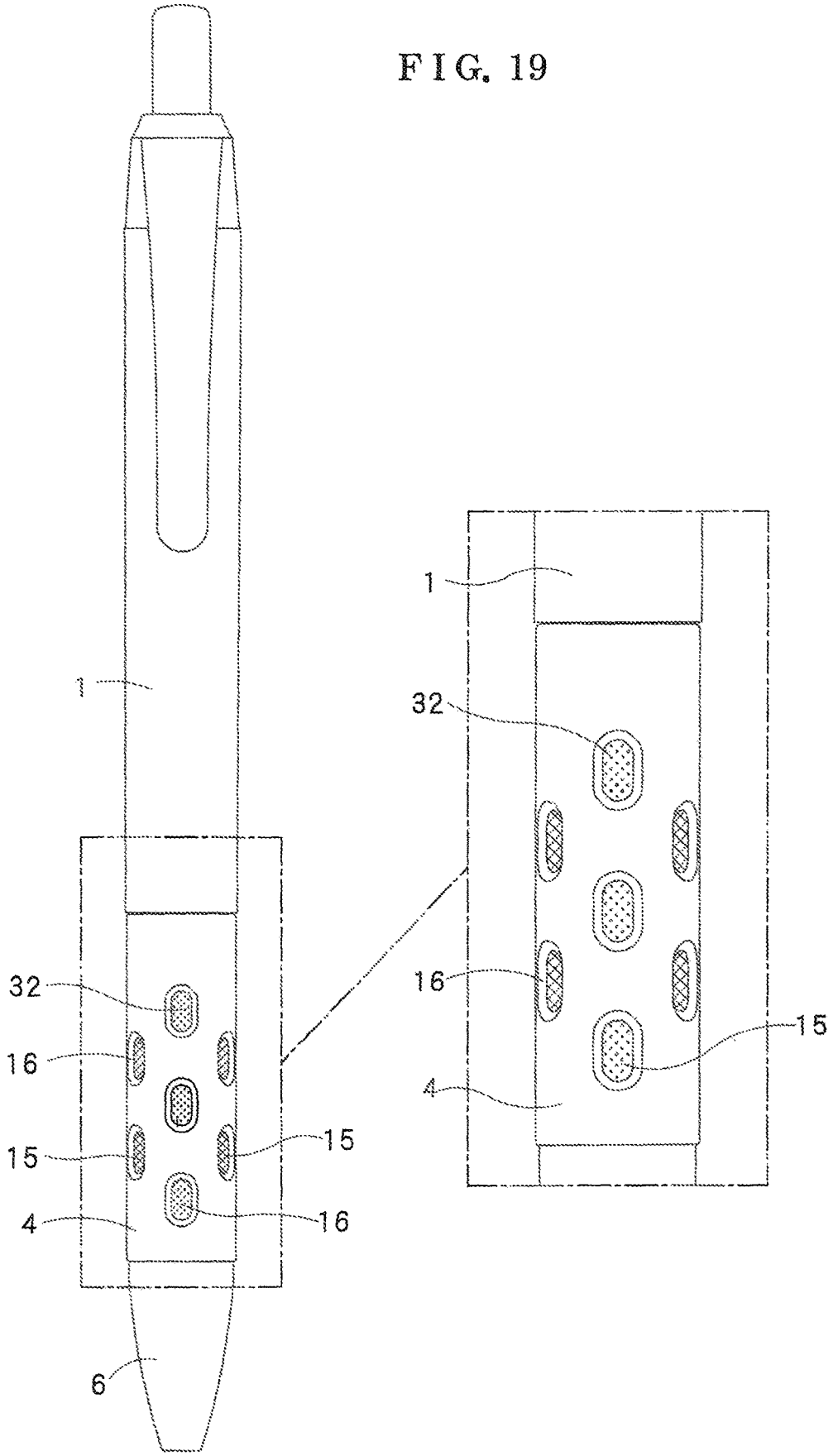
FIG. 19 is a front view of a writing instrument using the locking color piece.

Accordingly, by forcefully rotating the gripping tube 4 which is sandwiched between the tapered member 6 and the stepped portion 5 of the barrel, although the locking color piece 32 does not rotate, the locking groove 18 moves the locking color piece 32 having the locking pawl 17 formed thereon backward against the locking spring 24, by which the locked state of the gripping tube 4 is released. When the next locking groove 18 faces the locking pawl 17, the locking color piece 32 moves forward by the action of the locking spring 24 causing the locking pawl 17 to engage in the next locking groove 18, whereby the gripping tube is locked. As a result, as shown in FIG. 19, the gripping tube 4 can be locked at such a position that change of position is visible in the identifying mark 15 such as the color of the locking color piece 32 is visually recognized through the window portions 16.

In an example employing the color piece and the locking color piece as well, the locking pawl may be disposed at the side of the gripping tube and the locking groove may be disposed at the side of the color piece or the locking color piece. Further, the side of the color piece or the locking color piece may be fixed, and the gripping tube side may be disposed movably in the longitudinal direction of the barrel.

It will be appreciated by those of ordinary skill in the art that obvious changes, alterations and modifications can be made to the examples and embodiments described in the foregoing description without departing from the broad inventive concept thereof. It is understood, therefore, that this disclosure is not limited to the particular embodiments and examples disclosed, but is intended to cover all obvious changes, alterations and modifications thereof which are within the scope and sprit of the disclosure as defined by the appended claims.

What is claimed is:

1. A writing instrument having a color indication-changeable grip, comprising: a barrel; plural identifying marks disposed in parallel in a circumferential direction at a front portion of the barrel and having different identification characteristics that distinguish the identifying marks from one another; a gripping tube rotatably held on the barrel and covering the identifying marks; a window portion formed on the gripping tube and through which is visible an identifying mark selected by rotating the gripping tube relative to the barrel; and locking means disposed between the gripping tube and the barrel for releasably locking the gripping tube in releasable contact with the barrel, the locking means comprising a locking pawl and a locking groove with which the locking pawl engages, wherein the locking pawl is disposed at a side of one of the barrel or the gripping tube, the locking groove is disposed at a side of the other of the gripping tube or the barrel, and the locking pawl or the locking groove is mounted to undergo movement in a longitudinal direction of the barrel.

2. The writing instrument having a color indication-changeable grip according to claim 1; wherein the identifying marks comprise plural sets of identifying marks with each set having identification characteristics different from those of other sets, and wherein the identifying marks are arranged in parallel in the circumferential direction of the barrel so that a same identifying mark appears at every 30 degrees, the window portion comprises plural window portions disposed on the gripping tube so that a center line in a row in the longitudinal direction of the window portions is positioned at every 60 degrees, the locking means has plural locking grooves which respectively open at every 90 degrees at a rear end of the gripping tube, and the locking pawl is formed on a locking piece disposed movably within the barrel.

3. The writing instrument having a color indication-changeable grip according to claim 1; wherein the identifying marks are arranged in rows that extend in the longitudinal direction; and the window portion formed on the gripping tube comprises plural window portions arranged in rows that extend in the longitudinal direction, the window portions in each row registering with the identifying marks in rows having the same identification characteristics as the gripping tube is rotated.

4. The writing instrument having a color indication-changeable grip according to claim 1; wherein the identifying marks are circumferentially-spaced stripes extending in the longitudinal direction along a length of the front portion of the barrel, and the window portion comprises plural window portions arranged in rows extending in the longitudinal direction with each row having plural window portions.

5. A writing instrument having a color indication-changeable grip, comprising: a barrel; plural identifying marks disposed in parallel in a circumferential direction at a front portion of the barrel and having different identification characteristics that distinguish the identifying marks from one another; a gripping tube rotatably held on the barrel and covering the identifying marks; a window portion formed on the gripping tube and through which is visible an identifying mark selected by rotating the gripping tube relative to the barrel; locking means disposed between the gripping tube and the barrel for locking the gripping tube in releasable contact with the barrel; and a locking piece housed to undergo movement in a longitudinal direction within the barrel behind the gripping tube, wherein the locking means comprises a locking pawl and a locking groove which engages with the locking pawl, the locking groove is disposed on one of the gripping tube and the locking piece, the locking pawl is disposed on the other of the locking piece and the gripping tube, and the locking piece is urged by a locking spring in a direction that engages the locking pawl with the locking groove.

6. A writing instrument having a color indication-changeable grip, comprising: a barrel; plural identifying marks disposed in parallel in a circumferential direction at a front portion of the barrel and having different identification characteristics that distinguish the identifying marks from one another; a gripping tube rotatably held on the barrel and covering the identifying marks; a window portion formed on the gripping tube and through which is visible an identifying mark selected by rotating the gripping tube relative to the barrel; and locking means disposed between the gripping tube and the barrel for locking the gripping tube in releasable contact with the barrel, the locking means comprising a locking groove formed at a rear end of the gripping tube, and a locking pawl protruding from the barrel in the direction towards the gripping tube so that it engages with the locking groove, and connection and release of the locking means is effected by displacing the gripping tube in a longitudinal direction of the barrel.

7. The writing instrument having a color indication-changeable grip according to claim 6; wherein the identifying marks are arranged in rows that extend in the longitudinal direction, the identifying marks in any one row all having the same identification characteristics which are different from the identification characteristics of the identifying marks in adjacent rows; and the window portion formed on the gripping tube comprises plural window portions arranged in rows that extend in the longitudinal direction, the window portions in each row registering with the identifying marks in rows having the same identification characteristics as the gripping tube is rotated.

8. The writing instrument having a color indication-changeable grip according to claim 6; wherein the identifying marks are circumferentially-spaced stripes extending in the longitudinal direction along a length of the front portion of the barrel, and the window portion comprises plural window portions arranged in rows extending in the longitudinal direction with each row having plural window portions.

9. A writing instrument having a color indication-changeable grip, comprising: a barrel; a cylindrical color piece inserted over a front end of the barrel; plural identifying marks disposed in parallel in a circumferential direction on the color piece and having different identification characteristics that distinguish the identifying marks from one another; a gripping tube rotatably held on the color piece and covering the identifying marks; means attaching the color piece in a rotation-prevented state between the gripping tube and the front end of the barrel; a window portion formed on the gripping tube and through which is visible an identifying mark selected by rotating the gripping tube relative to the color piece; and locking means disposed between the gripping tube and the barrel for releasably locking the gripping tube in releasable contact with the barrel.

10. The writing instrument having a color indication-changeable grip according to claim 9; wherein the locking means comprises a locking pawl and a locking groove with which the locking pawl engages, the color piece is a locking color piece comprising the locking pawl or the locking groove, the gripping tube has the locking groove or the locking pawl disposed thereon, and the locking color piece is urged by a locking spring in a direction that engages the locking pawl with the locking groove.

* * * * *